US007484637B2

(12) United States Patent
Cutler, Sr. et al.

(10) Patent No.: US 7,484,637 B2
(45) Date of Patent: Feb. 3, 2009

(54) PAINT TRAY

(76) Inventors: Willard G. Cutler, Sr., 10 Easton St., Granby, MA (US) 01033; Willard G. Cutler, Jr., 78 Oxbow Rd., Northampton, MA (US) 01060

( * ) Notice: Subject to any disclaimer, the term of this patent is extended or adjusted under 35 U.S.C. 154(b) by 596 days.

(21) Appl. No.: 11/180,829

(22) Filed: Jul. 13, 2005

(65) Prior Publication Data

US 2006/0011636 A1 Jan. 19, 2006

Related U.S. Application Data

(60) Provisional application No. 60/587,658, filed on Jul. 14, 2004.

(51) Int. Cl.
*B05C 21/00* (2006.01)
*B65D 1/34* (2006.01)
*B65D 25/14* (2006.01)

(52) U.S. Cl. ..... 220/570; 220/571; 220/495.02

(58) Field of Classification Search ..... 220/571.1, 220/495.02; 15/257.05

See application file for complete search history.

(56) References Cited

U.S. PATENT DOCUMENTS 2,977,624 A * 4/1961 Tarr ..... 15/257.06
3,216,040 A * 11/1965 Harlow ..... 15/231
3,602,939 A * 9/1971 Schoenholz ..... 15/257.06
3,761,995 A * 10/1973 Rinard ..... 15/257.06
5,103,999 A * 4/1992 Elliott et al. ..... 220/570
6,622,884 B1 9/2003 Gartner
D524,003 S * 6/2006 Prokop et al. ..... D32/53.1

* cited by examiner

*Primary Examiner*—Anthony D Stashick
*Assistant Examiner*—Shawn M Braden
(74) *Attorney, Agent, or Firm*—McCormick, Paulding & Huber LLP

(57) ABSTRACT

A low cost, plastic, one-piece paint tray, which is optionally disposable or reusable, is thermoformed or molded and has a roller platform hinged at one of its ends to a base for pivotal movement relative to the base between use and non-use positions wherein, in a use position, the roller platform is disposed within the base and releasably attached as by snap fastener means to the base and wherein, in a non-use position, the roller platform is disposed exteriorly of the base for ease of cleaning, storage and shipment, the base being configured to support the roller platform at an inclined angle relative to the base in the use position and to provide communicating chambers under the roller platform when the platform is in a use position to increase the paint holding capacity of the paint tray.

6 Claims, 6 Drawing Sheets

PAINT TRAY

CROSS REFERENCE TO RELATED APPLICATION

This application claims the benefit of U.S. Provisional Application No. 60/587,658 filed Jul. 14, 2004.

FIELD OF THE INVENTION

The invention relates to a paint tray for use with a roller applicator.

BACKGROUND OF THE INVENTION

A wide variety of paint trays are available for holding paint or stain for use with roller applicators.

Many prior art paint trays are fabricated from metal or heavy cardboard and require the use of a protective liner for lining the tray if it is desired to avoid the trouble and inconvenience of cleaning the tray in preparation for reuse, with the protective liner being removed and discarded after a single use, thereby constituting an unwanted expense.

Paint trays of the prior art are most usually in the form of an open rectangle in plan, having an angularized interior bottom wall which serves as a platform leading to a well for receiving paint or stain, with the platform being provided with upstanding ribs over which an applicator is rolled for removing excess liquid from the applicator.

Such angularization of the paint tray bottom wall decreases substantially the size of the well, thereby reducing the amount of paint which can be held by the tray.

U.S. Pat. No. 5,103,999 discloses a cardboard paint tray formed from a cut-out having a complicated system of folding lines and flaps which must be erected to form the tray.

In U.S. Pat. No. 6,622,844, a thermoplastic paint tray having a separate cover which can be lost or misplaced, is disclosed.

SUMMARY OF THE INVENTION

A primary object of the invention is to provide a low cost, one-piece paint tray which can be thermoformed or molded from any suitably durable, lightweight, thermoplastic material, and which is optionally disposable or reusable.

Another object is to provide a tray for receiving paint or stain for use with a paint roller, with the tray having a base and a roller platform formed integrally therewith and hinged thereto for pivotal movement between a use position, wherein it is disposed in the interior of the base, and a non-use position, wherein it is disposed exteriorly of the base, thereby allowing for easy cleaning of the base and the roller platform.

As another feature of the invention, a paint tray is provided with a base having a bottom wall which is substantially flat and provided with abutments which support the roller platform in an inclined use position in the interior of the base wherein it is spaced upwardly of the bottom wall without significantly diminishing the capacity of the paint tray base, thereby permitting the paint tray to hold more paint or stain than paint trays of the prior art.

The paint tray hereof incorporates a novel accordion-type hinge which connects the roller platform to the paint tray base for pivotal, swinging movement between use and non-use positions and further incorporates snap fastener means on the roller platform and the paint tray base for releasably securing the roller platform to the paint tray base in the use position.

With the paint tray hereof, paint or stain is stored in the paint tray base not only forwardly of the roller platform, but also under the roller platform, with paint or stain feeding from under the roller platform to the front of the base through spaces provided between the roller platform and the base.

A plurality of one-piece paint trays embodying the invention can be stacked and shipped with the roller platform in an open or non-use position, thereby conserving space and permitting the packing of more units per shipping container.

DETAILED DESCRIPTION OF THE PREFERRED EMBODIMENT

Figures 1, 2, 3:
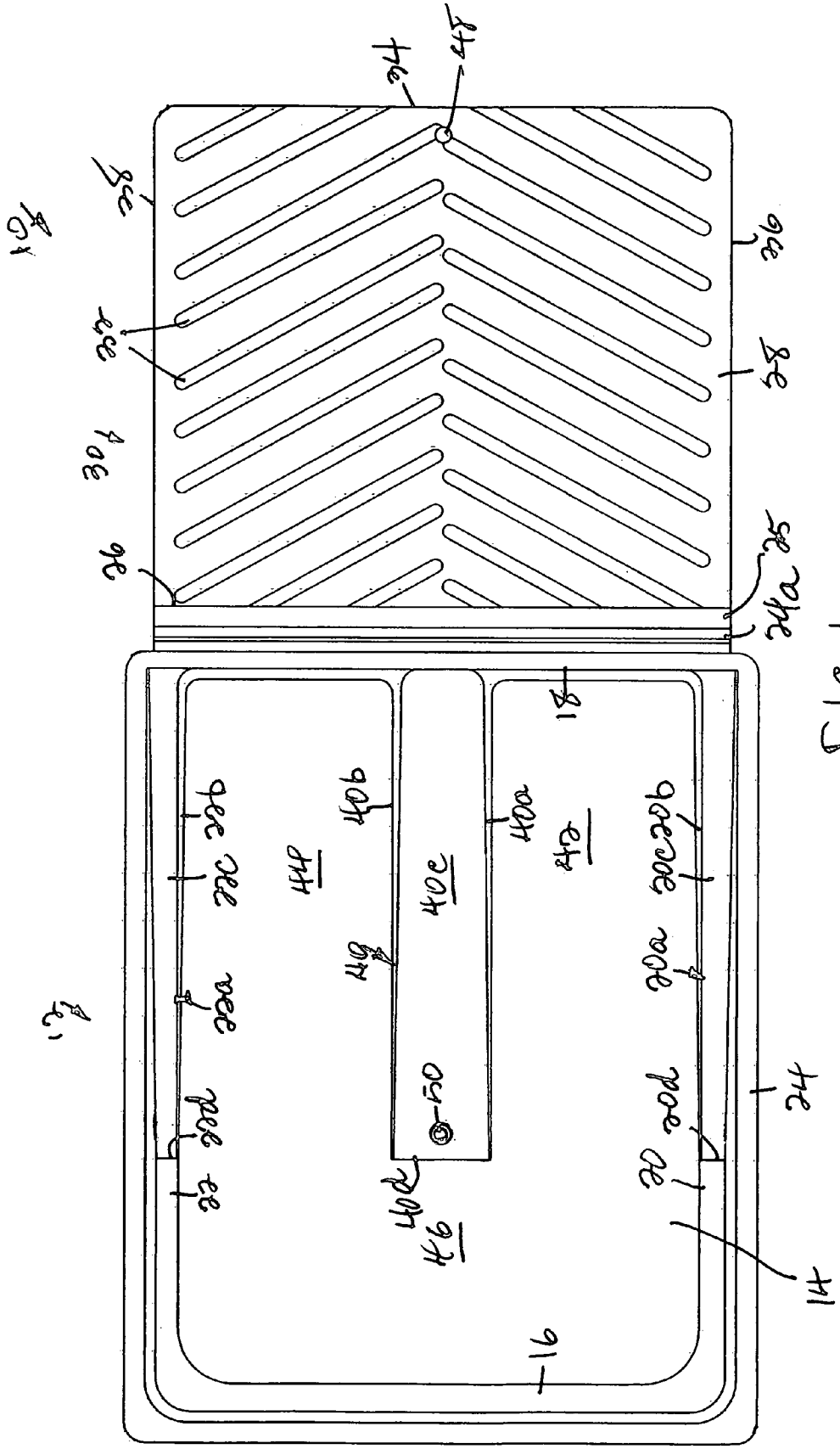
FIG. 1 is a top plan view of a paint tray embodying a preferred form of the invention showing the roller platform thereof in a fully open, or non-use position.
FIG. 2 is a bottom plan view of the paint tray of FIG. 1.
FIG. 3 is a top plan view of the paint tray of FIG. 1, with the roller platform thereof moved to a dosed, or use position.
Figures 1, 2:
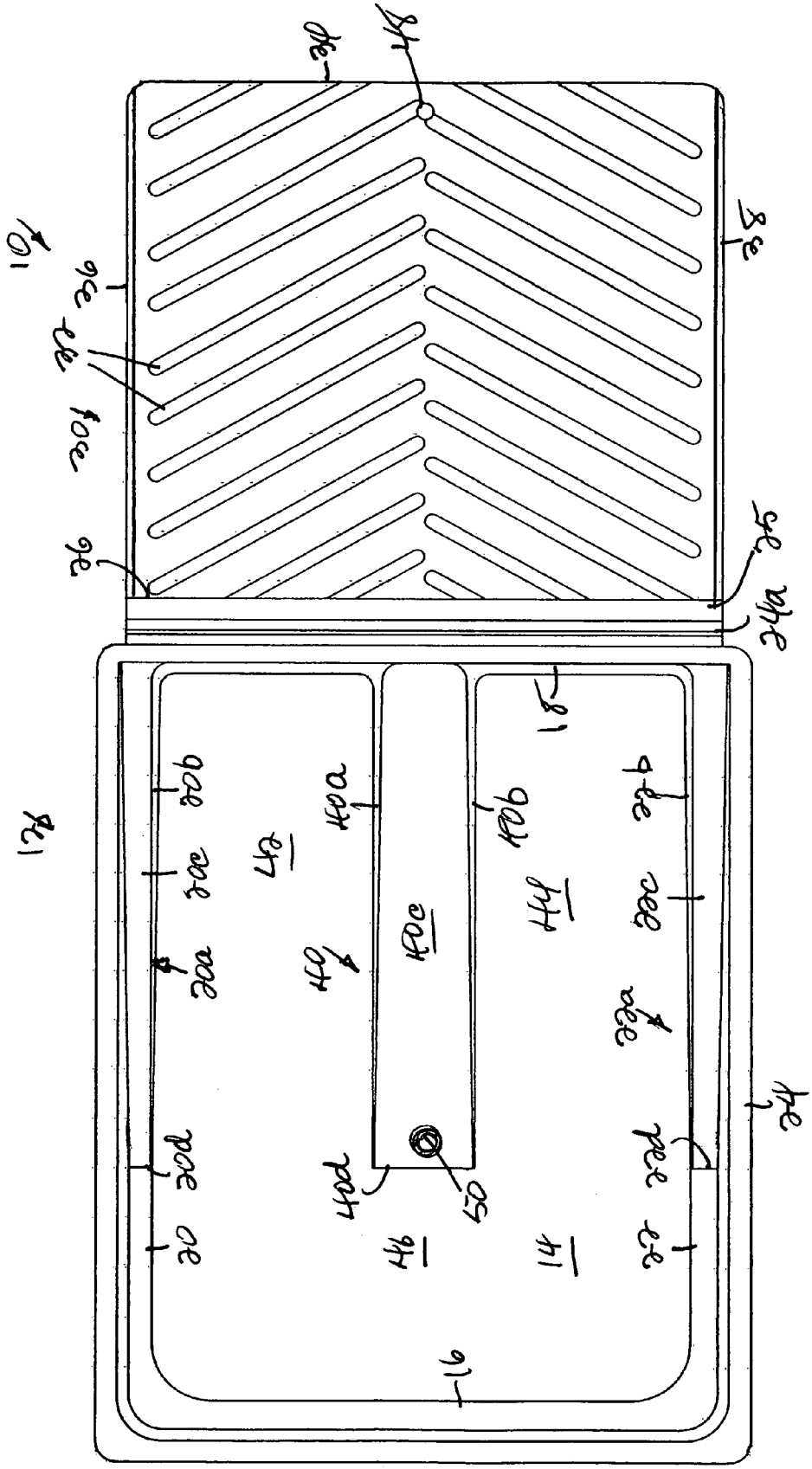
Figure 3:
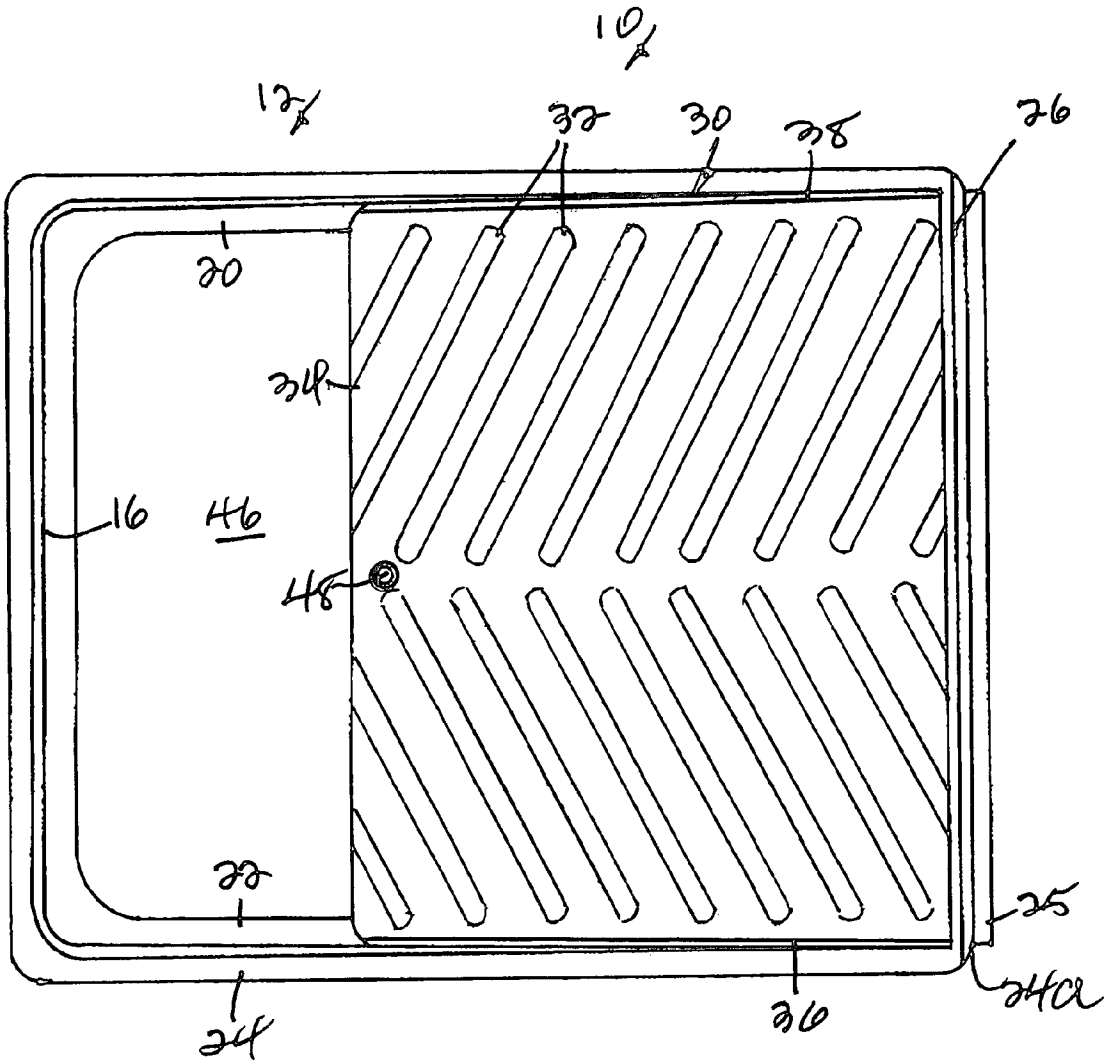
Figure 4:
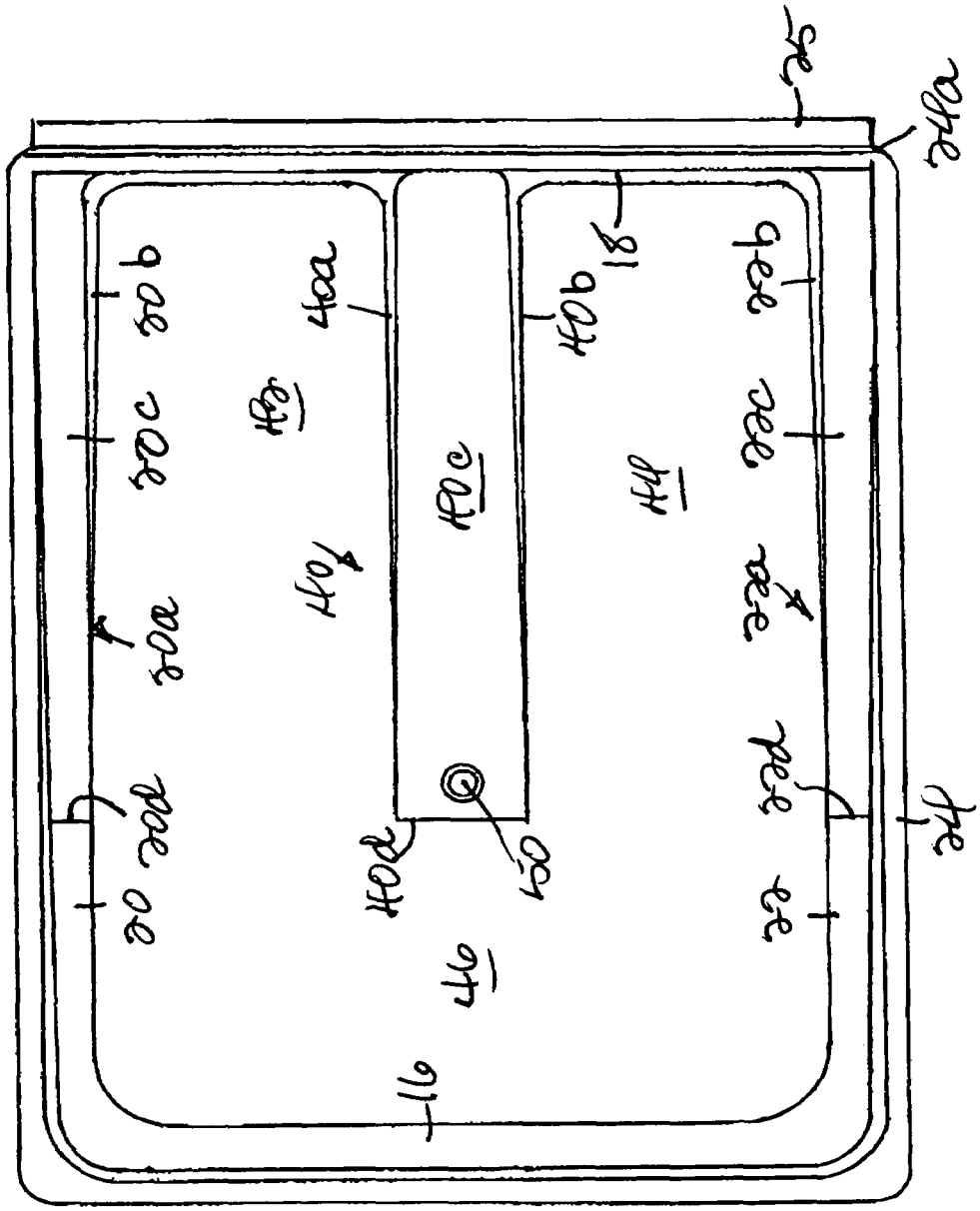
FIG. 4 is a bottom plan view of the paint tray of FIG. 3.

With reference to the drawings, a low cost, one-piece paint tray embodying a preferred form of the invention is generally indicated by 10 and includes a base, generally indicated by 12, for holding paint or stain or the like, and a roller platform, generally indicated by 30, for engagement by a paint roller, not shown, for removal of excess paint or stain from the roller.

Base 12 and roller platform 30 of paint tray 10 are thermoformed or molded as an integral unit from any suitably durable, lightweight, thermoplastic material, with the paint tray being optionally disposable or reusable.

Base 12 of paint tray 10 is substantially rectangular in plan and comprises a substantially horizontally-extending bottom wall 14, spaced, parallel first and second end walls 16 and 18 respectively, each of which extends substantially vertically upwardly from an adjacent end edge of bottom wall 14, and spaced, parallel first and second side walls 20 and 22 respectively, each of which extends substantially vertically upwardly from an adjacent side edge of bottom wall 14.

First side wall 20 of base 12 connects at one of its ends to an adjacent end of first end wall 16 and connects at its opposite end to an adjacent end of second end wall 18.

Second side wall 22 of base 12 connects at one of its ends to an adjacent end of first end wall 16 and connects at its opposite end to an adjacent end of second end wall 18.

A peripheral lip 24 is formed integrally with and extends horizontally-outwardly from the upper edge of each wall 16, 18, 20 and 22 of base 12.

Figure 6:
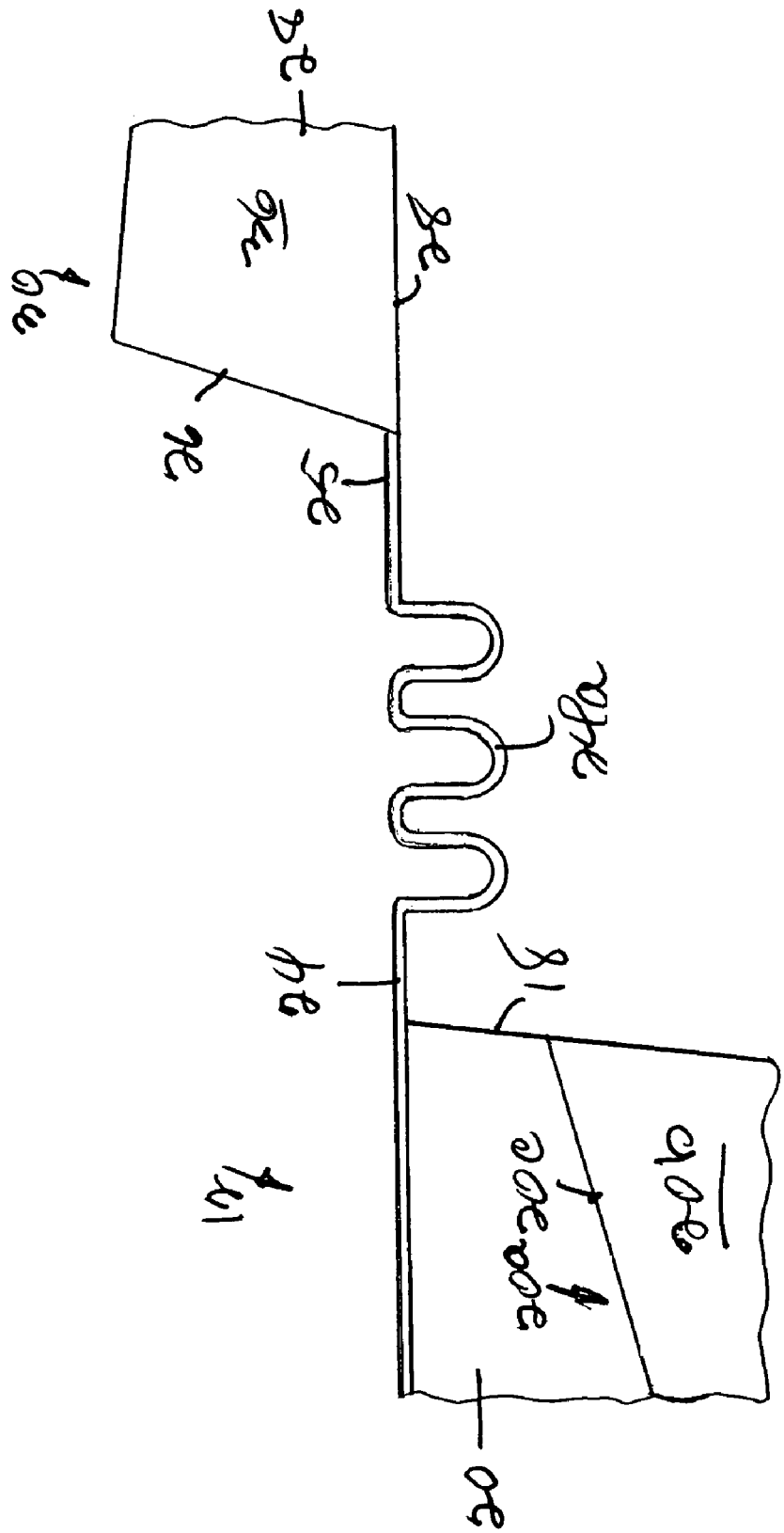
FIG. 6 is an enlarged, fragmentary, side elevational view of the accordion-type hinge connection between the paint tray and roller platform of the invention.

As best seen in FIG. 6, roller platform 30 and base 12 are interconnected by an accordion-type hinge 24*a* located adjacent end wall 18 of base 12, with hinge 24*a* extending between peripheral lip 24 and an outwardly extending lip 25 on an adjacent inner, upright end wall 26 of a base wall 28 of roller platform 30, whereby base 12 and the roller platform comprise a one-piece, integral unit.

Roller platform 30 is substantially rectangular in plan, with its base wall 28 having a series of spaced, angularized, upstanding ribs 32 on its upper face for engagement by a paint roller applicator, not shown, in usual manner.

Figure 5:
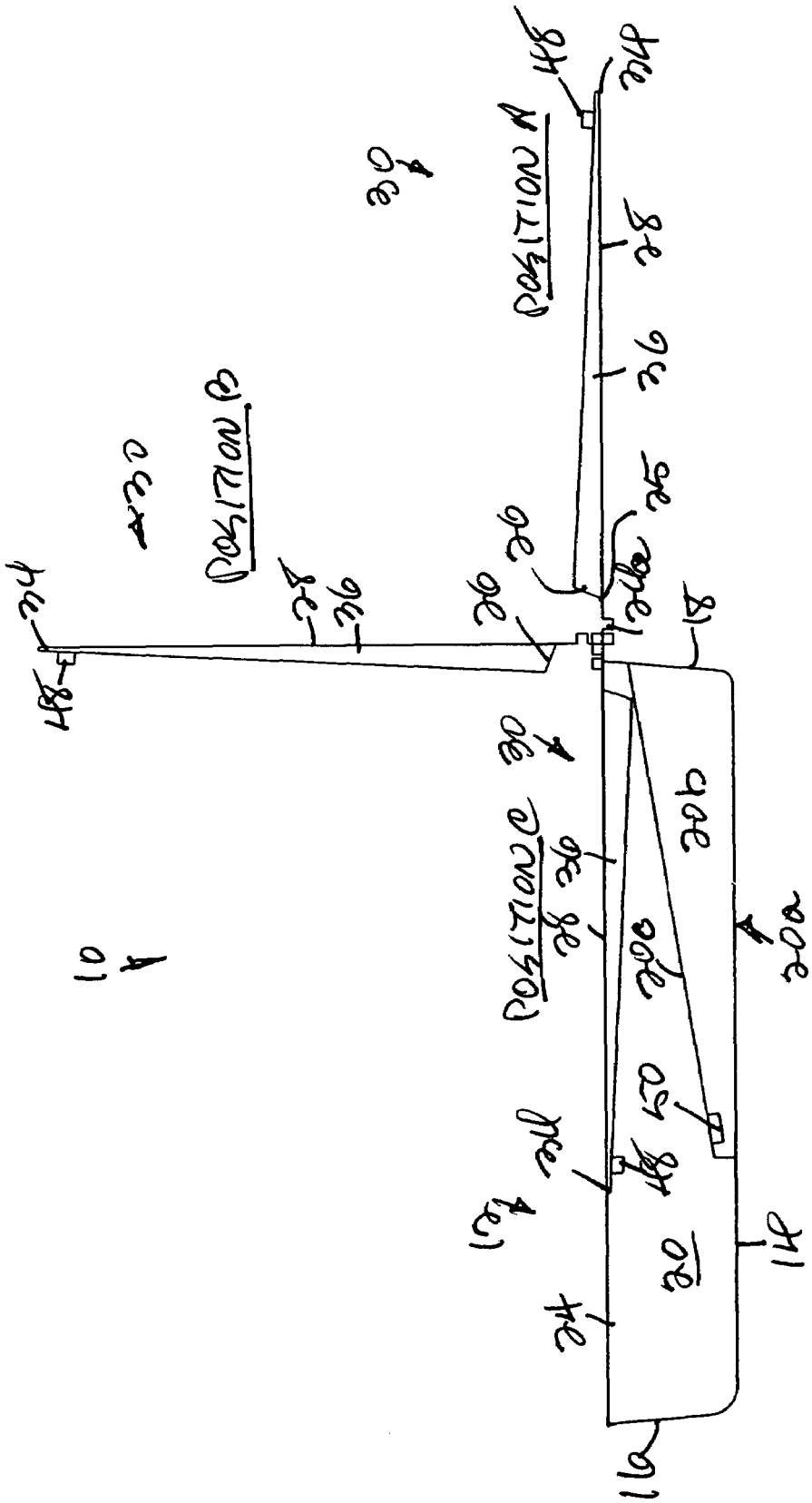
FIG. 5 is a somewhat diagrammatic side elevational view of the paint tray of FIG. 1 and showing the roller platform pivotally rotated relative to the paint tray between a fully open, horizontal, or non-use position; an upright, vertical, non-use position; and a partially-closed, horizontal position preparatory for use.

Base wall 28 of roller platform 30 has an outer end edge 34, which is disposed in spaced parallelism to inner, upright end wall 26 and has a pair of spaced, parallel, first and second side walls 36 and 38, respectively, each of which is triangulate in side elevation, as best seen in FIG. 5.

First side wall 36 of roller platform 30 extends between one end of inner end wall 26 and one end of outer end edge 34 of base wall 28.

Second side wall 38 of roller platform 30 extends between the opposite end of inner end wall 26 and the opposite end of outer end edge 34 of base wall 28.

Hinge 24*a* normally holds roller platform 30 in a horizontal, non-use position wherein it extends rearwardly from base 12, as shown in FIGS. 1 and 2 while also permitting pivotal movement of the roller platform relative to base 12 to any one of a number of positions, such as the positions shown graphically at Positions A, B and C in FIG. 5.

As shown in FIG. 3, roller platform 30 is of appropriate size and configuration as to be receivable between first and second side walls 20 and 22 of base 12 of paint tray 10 and to rest on the supporting surfaces of a trio of spaced, parallel, side abutments 20*a* and 22*a* and a central abutment 40 provided in the interior of base 12 and disposed below the plane of peripheral lip 24 of the base.

Side abutment 20*a* is molded into side wall 20 of base 12 and includes an interior wall 20*b* which is disposed inwardly of and parallel to side wall 20 and supports an upper wall 20*c* which inclines angularly downwardly from second end wall 18 and terminates inwardly from first end wall 16 at a support wall 20*d* which extends upwardly from the upper face of bottom wall 14 of base 12.

Side abutment 22*a* is molded into side wall 22 of base 12 and includes an interior wall 22*b* which is disposed inwardly of and parallel to side wall 22 and supports an upper wall 22*c* which inclines angularly downwardly from second end wall 18 and terminates inwardly from first end wall 16 at a support wall 22*d* which extends upwardly from the upper face of bottom wall 14 of base 12.

Central abutment 40, which is positioned centrally between side abutments 20*a* and 22*a*, is molded into bottom wall 14 of base 12 of paint tray 10 and includes a pair of spaced, parallel side walls 40*a* and 40*b* which support an upper wall 40*c* which inclines angularly downwardly from second end wall 18 and terminates inwardly from first end wall 16 at a support wall 40*d* which extends upwardly from the upper face of bottom wall 14 of base 12.

When roller platform 30 is pivoted into the use position as shown in FIG. 3, outer end edge 34 thereof is supported above bottom wall 14 of base 12 by side abutments 20*a* and 22*a* and central abutment 40, with the angle of inclination of the roller platform being set by the angle of inclination of upper wall 20*c* of side abutment 20*a*; upper wall 22*c* of side abutment 22*a*; and upper wall 40*c* of central abutment 40.

A snap type fastener 48 molded on the lower face of base wall 28 of the roller platform adjacent outer end edge 34 is engageable in an opening 50 provided in upper wall 40*c* of central abutment 40 for releasably securing the roller platform to base 12.

If desired, additional snap type fasteners, not shown, may be molded on base wall 28 of the roller platform for engagement with openings, not shown, in upper walls 20*c* and 22*c* of side wall abutments 20*a* and 22*a*, respectively.

A first paint or stain receiving chamber 42 is formed by side wall 40*a* of central abutment 40, bottom wall 14 of base 12, side wall 20*b* of side abutment 20*a* and second end wall 18.

A second paint or stain receiving chamber 44 is formed by side wall 40*b* of central abutment 40, bottom wall 14 of base 12, side wall 22*b* of side abutment 22*a* and second end wall 18.

Each of the paint-receiving chambers 42 and 44 communicates with and opens into a third paint-receiving chamber or well 46 disposed forwardly thereof and defined by bottom wall 14, first end wall 16 and side walls 20 and 22 of the base 12.

Paint passes freely from first and second paint receiving chambers, 42 and 44 respectively, into third paint receiving chamber 46 and under outer end edge 34 of base wall 28 of roller platform 30, which is supported upwardly of bottom wall 14 of base 12 by abutments 20*a*, 22*a* and 40, even when the roller platform is located in base 12 in the use position, thereby providing the base with increased paint holding capacity.

What is claimed is:

1. A thermoformed or molded unitary one-piece tray for receiving paint or stain for use with a paint roller comprising, a base, a roller platform and a hinge means formed integrally with both the base and roller platform for pivotally interconnecting the roller platform to the base, the paint roller being adapted to be rolled over the roller platform for removal of excess paint or stain therefrom, the hinge means connecting a first end of the roller platform to the base for pivotal movement between a use position wherein the roller platform is disposed entirely within the base for rolling contact by the paint roller and a non-use position wherein a second end of the roller platform extends outwardly from and in substantially horizontal alignment with the base and is disposed entirely exteriorly of the base for cleaning, storage, or shipment, and means in the base for supporting the roller platform in spaced relation to a bottom wall of the base in the use position comprising a series of spaced, inclined central and side abutments in the base for providing intercommunicating chambers for receiving and holding the paint and stain.

2. A thermoformed or molded unitary one-piece tray according to claim 1, including fastener means formed integrally with the roller platform and base for releasably securing the second end of the roller platform to the central abutment in the base in the use position.

3. A thermoformed or molded unitary one-piece tray according to claim 2, wherein the fastener means is a snap fastener molded on the roller platform and engageable with an opening molded in the base.

4. A thermoformed or molded unitary one-piece tray according to claim 1, wherein the hinge means interconnecting the roller platform to the base is an accordion-type hinge.

5. A thermoformed or molded unitary one-piece tray according to claim 1, including a series of upstanding ribs on the roller platform.

6. A thermoformed or molded unitary one-piece tray for receiving paint or stain for use with a paint roller comprising, a base, a roller platform over which the paint roller is adapted to be rolled for removal of excess paint or stain therefrom, hinge means connecting an end of the roller platform to the base for pivotal movement between a use position wherein the roller platform is disposed entirely within the base for rolling contact by the paint roller and a non-use position wherein the roller platform extends outwardly from and in substantially horizontal alignment with the base and is disposed entirely exteriorly of the base for cleaning, storage, or shipment, and means in the base comprising a series of spaced central and side abutments for supporting the roller platform at an inclined angle in spaced relation to a bottom wall of the base in the use position and providing intercommunicating chambers for receiving and holding the paint and stain.

* * * * *